US011619359B2

(12) United States Patent
Castillo Recatala

(10) Patent No.: US 11,619,359 B2
(45) Date of Patent: Apr. 4, 2023

(54) ROAD TUNNEL LIGHTING SYSTEM WITH CONTINUOUS PLURALITY OF LIGHTING DEVICES

(71) Applicant: SACYR CONCESIONES S.L., Madrid (ES)

(72) Inventor: Daniel Castillo Recatala, Casabermeja (ES)

(73) Assignee: SACYR CONCESIONES S.L., Madrid (ES)

( * ) Notice: Subject to any disclaimer, the term of this patent is extended or adjusted under 35 U.S.C. 154(b) by 0 days.

(21) Appl. No.: 17/431,423

(22) PCT Filed: Feb. 6, 2020

(86) PCT No.: PCT/ES2020/070082

§ 371 (c)(1),
(2) Date: Aug. 16, 2021

(87) PCT Pub. No.: WO2020/165477

PCT Pub. Date: Aug. 20, 2020

(65) Prior Publication Data

US 2022/0120399 A1 Apr. 21, 2022

(30) Foreign Application Priority Data

Feb. 15, 2019 (ES) ..... ES201930117

(51) Int. Cl.
*F21V 21/14* (2006.01)
*F21S 8/08* (2006.01)
(Continued)

(52) U.S. Cl.
CPC ..... *F21S 8/086* (2013.01); *F21V 5/04* (2013.01); *F21V 23/004* (2013.01); *F21Y 2115/10* (2016.08)

(58) Field of Classification Search
CPC ..... F21V 14/02; F21V 23/004; F21V 21/02; F21V 21/14; F21V 21/30; F21Y 2115/10; F21Y 2103/10
See application file for complete search history.

(56) References Cited

U.S. PATENT DOCUMENTS 2,846,570 A * 8/1958 Harling ..... F21V 21/116 362/396
6,561,690 B2 * 5/2003 Balestriero ..... F21V 17/101 362/240
(Continued)

FOREIGN PATENT DOCUMENTS

CN 102374452 A 3/2012
CN 202813029 U 3/2013
(Continued)

OTHER PUBLICATIONS

I2Systems, V-Line Gen 4, V4290, Miniature High Output LED Illumination, Wet Location (Copyrighted 2011), all pages https://www.i2systems.com/uploads/files/i2Systems_VLine_V4290_C.pdf (Year: 2011).*
(Continued)

*Primary Examiner* — Ismael Negron
(74) *Attorney, Agent, or Firm* — Marshall, Gerstein & Borun LLP

(57) ABSTRACT

A lighting system having a plurality of lighting devices continuously arranged along the longitudinal direction of a tunnel, such that the distance between the lighting devices corresponds to the flicker frequency for the speed of traffic traveling through the tunnel. Each of the lighting devices includes a longitudinal base, means for securing the base to the tunnel, a translucent cover, at least one printed circuit board (PCB), and a plurality of light emitting diodes (LEDs) arranged on the PCB to form at least one row. The distance between the LEDs is selected such that the angle of emission
(Continued)

of the LEDs, provide in the longitudinal direction, a substantially uniform illumination distribution at the desired height of the lighting device. The means of securing the base to the tunnel enables adjustment of an angle of inclination of each lighting device, relative to the transverse direction of the tunnel to create a substantially uniform light output.

16 Claims, 9 Drawing Sheets

(51) Int. Cl.
*F21V 5/04* (2006.01)
*F21V 23/00* (2015.01)
*F21Y 115/10* (2016.01)

(56) References Cited

U.S. PATENT DOCUMENTS 6,578,979 B2 * 6/2003 Truttmann-Battig ... F25D 27/00 362/240
8,104,920 B2 * 1/2012 Dubord ..... F21V 19/0045 362/225
8,157,420 B2 * 4/2012 Song ..... F21V 21/30 362/373
8,777,448 B2 * 7/2014 Shimizu ..... F21K 9/27 362/241
8,888,314 B2 * 11/2014 Gill ..... F21S 4/28 362/240
2009/0185379 A1 * 7/2009 Chen ..... F21V 19/0045 362/373
2011/0211330 A1 * 9/2011 Wang ..... H05B 45/00 362/20
2011/0261564 A1 * 10/2011 Grootveld ..... F21S 8/00 362/249.02
2011/0304270 A1 * 12/2011 Scarpelli ..... F21V 29/507 315/113
2012/0113643 A1 * 5/2012 Chang ..... F21S 4/28 362/249.02
2013/0093325 A1 * 4/2013 Scarpelli ..... F21S 4/28 315/85

FOREIGN PATENT DOCUMENTS

EP 2112428 A1 * 10/2009 ..... F21S 2/00
ES 2375884 T3 3/2012
ES 2507440 A1 * 10/2014 ..... F21S 4/28
GB 1046462 A 10/1966
KR 20120069323 A * 6/2012 ..... F21S 2/00
WO WO-2011117908 A2 * 9/2011 ..... F21S 4/28
WO WO-2018/065651 A1 4/2018

OTHER PUBLICATIONS

I2Systems, V-Line Gen 4, V4295, Installation Guide (Copyrighted 2012), pp. 7, 10 and 12 https://www.i2systems.com/uploads/install_guides/i2Systems_InstallGuide_Gen4_A.pdf (Year: 2012).*
International Search Report for PCT/ES2020/070082, dated Jun. 10, 2020.

* cited by examiner

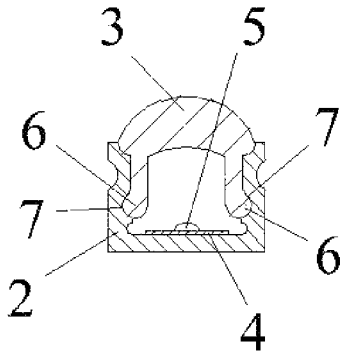
Fig. 2.1
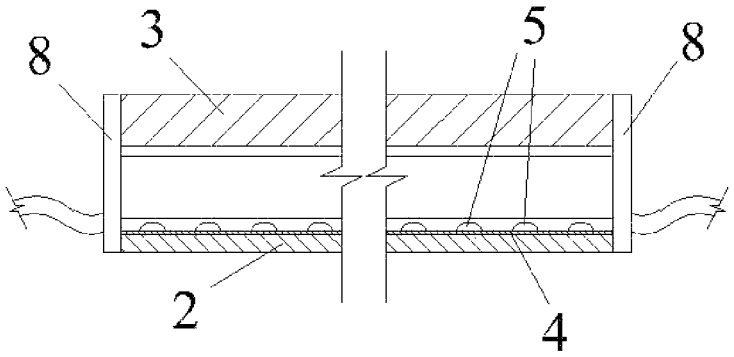
Fig. 2.2

ROAD TUNNEL LIGHTING SYSTEM WITH CONTINUOUS PLURALITY OF LIGHTING DEVICES

TECHNICAL FIELD OF THE INVENTION

The present invention corresponds to lighting systems for road tunnels and, in particular, to a lighting system for the same having a continuously arranged plurality of lighting devices.

BACKGROUND OF THE INVENTION

There exists at the present time wide experience in the design of lighting for tunnels and, in particular, for stretches of tunnels presenting particular requirements by virtue of the fact that they include dark points or zones within the path to be travelled along by the driver.

The principal problem is generated due to the high contrast between the low lighting existing within the interior of the tunnels and the high external luminances during the day, thereby producing visibility problems by virtue of the difficulties of adaptation of the human eye of drivers.

This problem occurs at the entrance of the tunnel by virtue of the fact that the eyes of drivers are already adapted to the high natural lighting existing outside the tunnel and a particular distribution of luminances may produce the known black hole effect, preventing drivers from seeing within the interior of the tunnel when they are at a given distance from the mouth of the same.

Furthermore, at the exit of the tunnel the contrary effect is generated by virtue of the contrast between the low interior lighting within the tunnel and the high lighting existing outside the tunnel, thereby reducing the response capacity of the driver until his/her eyes become accustomed to the new level of exterior luminance.

Given that the visual adaptation of the human eye is progressive and requires a certain time, the lighting within the interior of tunnels is divided into zones denominated threshold, transition, interior and exit, the length whereof depends on the speed of the road and the length of the tunnel.

Each of these zones requires levels of lighting that vary as a function of the lighting conditions exterior to the tunnel. The length of the transition zone and that of the exit zone is normally much shorter than that of the interior zone. Nevertheless, by virtue of the diurnal lighting requirements thereof, the energy consumed by these zones represents the majority of the energy consumed by the lighting of the tunnel in spite of the fact that these zones are shorter in length.

In addition to the level of luminance, other factors must be taken into account, such as the uniformity in the lighting, avoiding zebra effects and dark zones, distributing the points of light such as to avoid generating a flicker effect, consisting of pulsing due to the cyclic variations of the luminance in the field of vision, and to avoid a Purkinje effect, by virtue of the change in the form of vision of the eye.

The systems of tunnel lighting generally comprise permanent illumination, switched on all the time along the entire length of tunnel, and reinforcement illumination, switched on during the day, solely in the threshold and exit zones.

These forms of lighting generate high electrical consumption, both from the permanent lighting, switched on during the entire day, and from the reinforcement lighting, which represents a high additional power consumption.

Sodium vapor lamps have generally been utilized in the lighting of tunnels because of their high luminous efficacy, the luminous efficacy being greater the higher the power consumption by the lamps. The utilization of luminaires of higher power permits a greater separation between the same, however this separation must be controlled by virtue of the fact that if they are excessively separated the aforementioned zebra effect, or lack of longitudinal uniformity, is generated.

The appearance of LED technology offers the possibility of utilizing luminaires of high efficacy at lower prices, resulting in a great advantage given the high power consumption by lighting in tunnels.

In addition, LED lighting produces other advantages, such as a longer useful life and, consequently, maintenance savings and less reduction in performance over time, together with the ability to select the color temperature and regulate the consumption in conformity with the lighting requirements.

However, in spite of all these possible advantages, at the present time the utilization of LED technology in the lighting of tunnels has not been implemented as was to be expected and has simply been limited to the manufacture of light fittings for tunnels, similar to those in existence for sodium vapor lamps but with LEDs.

This has not achieved a great advantage because the most advanced LEDs have a luminous efficacy similar to the 400 W high pressure sodium vapor lamps. For this reason, the majority of the studies on changing to LEDs have been limited to permanent lighting where a small advantage in luminous efficacy may indeed be achieved as compared with the HPSV (high pressure sodium vapor) light fittings of 150 W or 250 W, which are normally distributed at distances of between 20 and 30 meters.

Nevertheless, there has been no reason to study this possibility with respect to reinforcement lighting, and the savings produced with respect to permanent lighting are so small that the return on the investment required to change the existing HPSV light fittings for others of LEDs is questionable.

CN102374452, for example, reveals the employment of LED light fittings of between 80 and 200 W and includes diverse tables presenting the results of luminances obtained through these light sources in the different stretches of a tunnel. This document discusses the advantages of the useful life of the LED lamps in comparison with other technologies (fluorescent, metal halide, HPSV, etc.), the better control of the level of lighting provided by the LED lamps as a function of the exterior characteristics, and the fact that the LED lamps are directional and not disperse sources (voluminous lamps which distribute the light in all directions). This document also discusses the high color rendering index (CRI) in comparison with other sources, such as the sodium vapor lamps. All these circumstances signify that a system of lighting of tunnels with LEDs is economically more sensible and leads to an improvement in safety.

However, this document does not discuss any improvements in regard to the utilization of LEDs so as to obtain a great uniformity in the lighting of the tunnel, approaching 100%, by means of the employment of points of light of low power distributed at small distances. This document also does not discuss taking advantage of the possible directionality of the LEDs.

WO2018065651, which is owned by the present Applicant, improves on this approach by disclosing a system of lighting based upon the employment of small LED lights, instead of large lamps, in order to achieve a distribution approaching 100% uniformity. The system takes advantage of the possibility offered by the LEDs of realizing this distribution with points of low power, and, at the same time, directs the light to the carriageway and the surroundings required to be lit (such as hard shoulders and sidewalks) in a precise manner and without any wastage.

The system disclosed in WO2018065651 differs from that set out in CN102374452, as the latter solely considers the angle of inclination of the light fittings in the transverse direction of the tunnel, whereas in WO2018065651, in order to achieve a uniformity approaching 100%, the light emitting devices are provided with closure lenses, rendering possible a predetermined angle of emission of the light rays in the longitudinal direction.

Consequently, the system set out in WO2018065651 does not seek to employ LED light fittings of greater power for the sole objective of replacing those of other technologies (principally high pressure sodium vapor) at spacings similar to those currently employed with this technology. In other words, the system set out in WO2018065651 does not seek to replace an existing system of lighting with another having luminaires with LEDs situated at the same points. Instead, WO2018065651 seeks to provide a totally new system having a continuous distribution of small points of light.

However, the most recent research by the Applicant has led to the conclusion that system set out in WO2018065651 may be improved in certain aspects, namely that because the system is formed by multiple luminaires, each of which is constituted by a LED that is secured to the tunnel and has its own closure lens, requires a more complicated and slower installation as compared to an installation involving an assembly of lighting devices or luminaires incorporating a plurality of LED light sources in a combined manner.

In addition, the greater the separation between luminaires, the greater the requirement that the maximum power of the luminaires be the same in order to cover with the light rays the object area of lighting between both luminaires, and thereby prevent shadow zones. However, because of the greater power requirements, the luminaires have a lower useful life.

Furthermore, given that each luminaire is secured in an independent manner to the tunnel, means of anchoring each of said luminaires is required, which is costly, both financially and in terms of installation time and labor.

Consequently, it is necessary to find a new system that resolves these disadvantages, but also maintains a uniform light distribution in the tunnel approaching 100%.

BRIEF SUMMARY OF THE INVENTION

A lighting system for road tunnels is provided. The lighting system includes a plurality of lighting devices or luminaries secured within an interior of a tunnel. These lighting devices are disposed in a consecutive manner and separated one from another by a distance that corresponds to the flicker frequency for the speed of traffic traveling through the tunnel.

Each of the lighting devices includes a longitudinal base, means of securing the base to the interior of the tunnel, and a transparent or translucent closure element including first means of affixation for fixing the closure element to said base. The length of the first means is equal to the length of the closure element. Each lighting device also includes at least one printed circuit board (PCB) disposed within the interior of the light device, secured to the base, and connected to an electrical network through means of connection, and a plurality of LED light sources disposed on the at least one PCB, such that each PCB constitutes the means of securing and the supply circuits of a plurality of LED light sources. These LED light sources are disposed in at least one row in the longitudinal direction of the PCB.

The LED light sources are separated at a distance from one another such that the angle of emission of light rays from the LED light sources provide a substantially uniform illumination output to an object area in the longitudinal direction of the tunnel. The exact value of the distance between the LED light sources depends upon the positioning height of the lighting device.

The means of securing the base to the interior of the tunnel includes means of adjusting an angle of inclination of the light rays in the transverse direction of the tunnel, such that the angles of emission and of inclination can be adjusted to provide the substantially uniform illumination output.

The continuous lighting system proposed herein represents a significant improvement over the state of the art. More particularly, in the proposed system, each lighting device includes a plurality of LED light sources connected to a PCB. The system differs from other systems, wherein each LED light source constitutes an independent lighting device having an individual lens closure thereof, because in the proposed system each lighting device contains multiple light sources (in this case LED light sources), together with means of securing the device to the tunnel as an assembly instead of requiring each LED light source to be separately secured. All this permits greater simplicity in the assembly and installation of the lighting system, which thereby significantly reduces installation times and the costs of said items and the labor for installing the lighting system.

Furthermore, in terms of the electrical connection, each of the LED light sources is connected to a PCB, and the PCB is connected to the supply network, thereby reducing the need for multiple connections and, consequently, reducing installation time and reducing material and labor costs.

In addition, this system has the advantage of providing continuous lighting by virtue of said proximity between the LED light sources.

Moreover, the system may, if necessary, utilize a plurality of orientation elements and optical elements, such as lenses or reflectors, each associated with one or several LED light sources, such that the lighting can be adjusted to obtain the desired photometry, both symmetrically and asymmetrically in the transverse and longitudinal planes.

Because this lighting system enables adjustment of the angle of inclination and the angle of emission, the lighting projected onto the object area has a substantially uniform illumination distribution in the longitudinal direction of the tunnel. This produces a very efficacious system that is simple to install (shorter install times and lower install costs), is durable, and performs well, which translates into less repair and maintenance work.

BRIEF DESCRIPTION OF THE DRAWINGS

FIGS. 2.1 and 2.2 show longitudinal and transverse cross-sections of the lighting device of FIG. 1.

DETAILED DESCRIPTION

In a first preferential embodiment of the invention, a lighting system for road tunnels is provided, the lighting system including a plurality of luminaires or lighting devices (1) secured within an interior of the tunnel such that the luminaires (1) are continuously arranged along a longitudinal direction of the tunnel.

Figure 5:
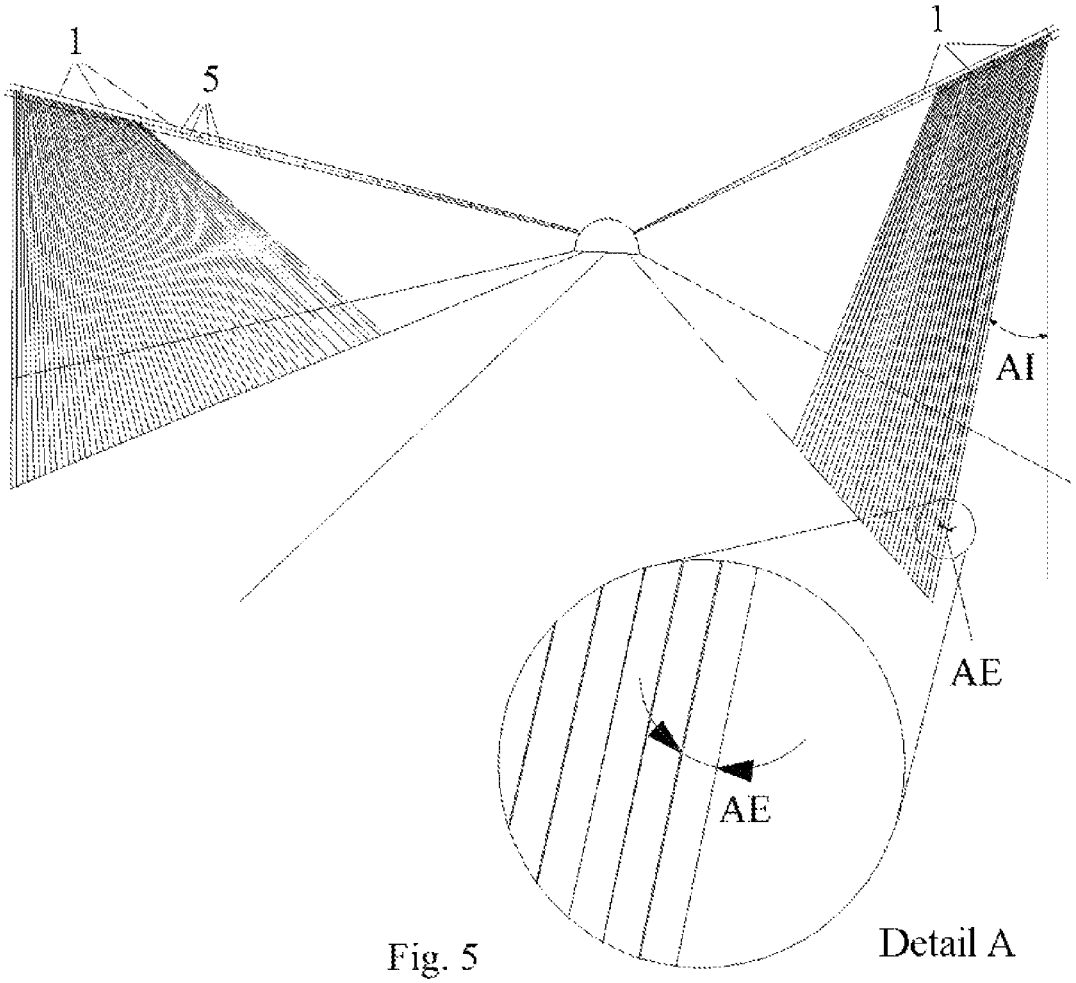
FIG. 5 shows a perspective view of a tunnel having a continuous lighting system for road tunnels, the continuous lighting system including a plurality of the lighting devices of FIG. 1.

As is shown in FIG. 5, which depicts the first preferential embodiment of the invention, the luminaires or lighting devices (1) are secured upon the wall of the tunnel at a height between 20 cm and 5 m and present an appearance of continuous lighting. Nevertheless, in other embodiments, the luminaires or lighting devices (1) may be secured upon the roof of the tunnel.

In FIG. 5, it may also be observed that the luminaires or lighting devices (1) are disposed in a consecutive manner and are separated by a distance shorter than that of the flicker frequency for the speed of traffic corresponding to the tunnel in which they are secured. In this first preferential embodiment of the invention, the luminaires or lighting devices (1) are disposed in the longitudinal direction of the tunnel, and the speed limit of the tunnel is 100 km/h and the flicker frequency is 15 Hz, so distance between each of the luminaires or lighting devices (1) must be less than 1.85 m.

Figure 1:
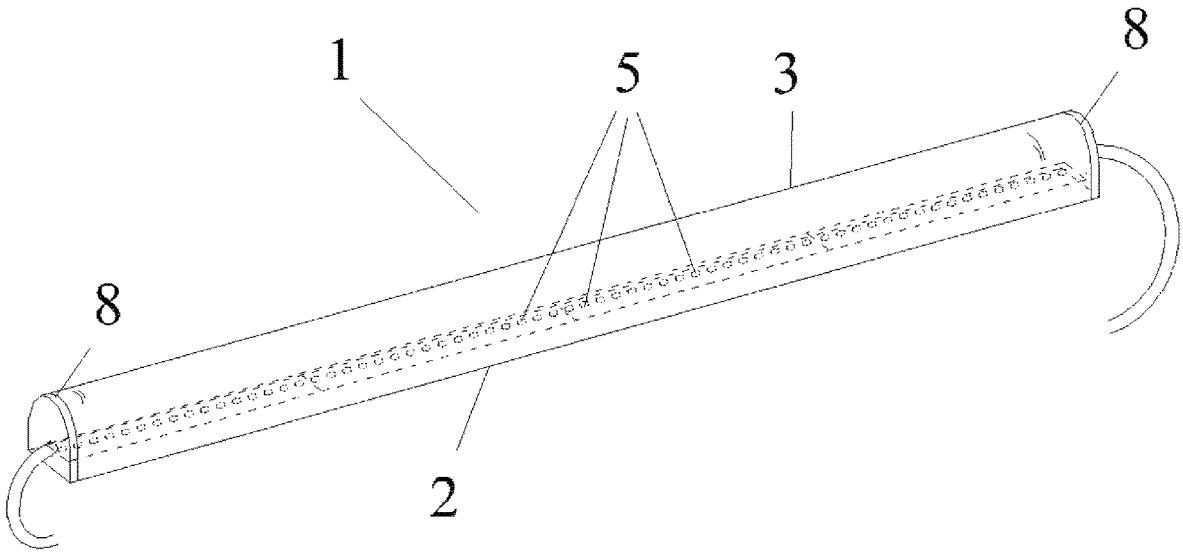
FIG. 1 shows a perspective view of a lighting device of a continuous lighting system for road tunnels, in accordance with a first preferential embodiment of the invention.

Furthermore, as is shown in FIGS. 1, 2.1 and 2.2, each of the luminaires or lighting devices (1) comprises a longitudinal base (2). In this first preferential embodiment, the longitudinal base (2) is formed by a longitudinal extrusion of aluminum, however, in other embodiments, the longitudinal base (2) may be partly formed of aluminum, may be made of another material formed by casting or press forming, or may be a ribbed plate. This base (2) additionally includes means of securing the luminaire or lighting device (1) to the interior of the tunnel.

The lighting device (1) or luminaire in turn comprises a transparent or translucent closure element (3) secured to said base (2) via a first means of securing and having a length equal to the length of the base (2). The lighting device (1) also includes at least one printed circuit board (PCB) (4) disposed within the interior of the lighting device (1), secured to the base (2), and electrically connected to an electrical supply network through a means of connecting the lighting device to the electrical supply network. The lighting device (1) also includes a plurality of LED light sources (5) disposed on the PCB (4) so as to form at least one row in the longitudinal direction of the PCB (4). As is shown in FIG. 1, in the first preferential embodiment of the invention, the plurality of LED light sources (5) are disposed in a single row.

Figure 6:
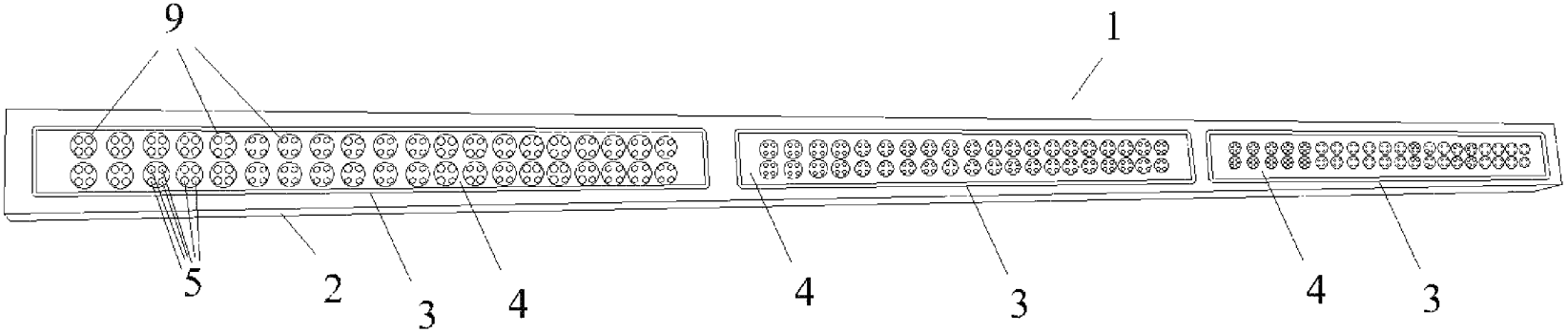
FIG. 6 shows a perspective view of a lighting device of a continuous lighting system for road tunnels, in accordance with a second preferential embodiment of the invention.

However, in other embodiment, the plurality of LED sources (5) may be disposed in 2, 3, or any other required number of rows, as shown in FIG. 6, which depicts a second preferential embodiment wherein the LED light sources (5) are disposed in two rows in the longitudinal direction of the PCB (4).

The LED light sources (5) are separated at a distance therebetween such that the angle of emission (AE) of light rays projected upon an object area in the longitudinal direction of the tunnel is the same for each pair of consecutive LED light sources (5), as shown in detail A of FIG. 5. The distance between the LEDs (5) depends on the height at which the lighting device (1) is positioned. The height, may, for example, be between 20 cm and 5 m, according to the particular conditions of the tunnel to be illuminated.

FIG. 5 only shows the light rays of the LED light sources (5) of two luminaires or lighting devices (1) on both sides of the carriageway (in order to not overload the figure with the lines corresponding to the rays of all the LEDs), yet FIG. 5 is sufficient for illustrating the continuity of said light rays projected upon the carriageway. This continuity may be especially appreciated in detail A of FIG. 5, which shows the proximity of the light rays. This continuity is practically complete from the position of the LEDs (5) wherefrom the light rays emerge to the carriageway, as shown in FIG. 5, with a small separation existing in the highest zone, where the LED light sources (5) are located, that small separation being inappreciable to the human eye. This is the reason why the disclosed solution achieves the desired continuity achieved.

Furthermore, the means of securing the base (2) to the interior of the tunnel comprises means adjusting an angle of inclination (AI) of the light ray in the transverse direction of the tunnel. Adjustment of the angles of emission and of inclination (AE, AI) permits a lighting of the object area to achieve a longitudinal distribution having a uniformity approaching 100%.

In the first preferential embodiment, the object area is a carriageway, however, in embodiments, the object area may be a part of the same.

In the first preferential embodiment, the base (2) of the lighting device (1), formed by an aluminum extrusion, has a length of 2 m. However, in other embodiments, depending upon the length of the tunnel, extrusions having different lengths may be utilized. For example, extrusions having lengths within a range from 20 cm to 3 m may be utilized.

In the first preferential embodiment, the transparent or translucent closure element (3) is itself formed by an optical lens disposed over a plurality of LED light sources (5). Consequently, in this first preferential embodiment, the lens is longitudinal and has the same length as the base (2) to which it is secured.

However, in other embodiments, the lighting device (1) may, within its interior, include at least one optical lens (9) disposed over at least one LED light source (5) and secured to the base (2) via second means of securing to the base (2).

For example, in the second preferential embodiment of the invention represented in FIG. 6, the luminaire or lighting device (1) comprises three PCBs (4) and a plurality of LED light sources (5). The luminaire or lighting device (1) in this embodiment also includes optical lenses (9) disposed over said LED light sources (5), such that each lens (9) is disposed, in this example, over four LED light sources (5). The transparent or translucent closure element (3) is disposed over all these lenses (9).

In addition, in this second preferential embodiment of the invention, at least one of the optical lenses (9) is different from that of the remaining optical lenses (9) such that the desired photometry may be obtained.

In the first preferential embodiment, the lens is longitudinal and coincident with the closure element (3), and the closure element (3) is formed of polycarbonate. Nevertheless, any person of ordinary skill in the art will understand that other materials having similar characteristics may be utilized. In the first preferential embodiment, the first means of securing the closure element (3) to the base (2) is formed by lateral clips (6) each suitable for interlocking engagement into the same number of grooves (7) formed in the sides of the base (2), as shown in FIG. 2.1.

In the first preferential embodiment of the invention, each luminaire or lighting device (1) comprises in the interior thereof four consecutive PCBs (4) each having a thickness of 8 mm and a length of 497 mm. To each of the PCBs (4) there are connected 16 LED light sources (5), connected in series.

In embodiments, depending upon the length of the lighting device (1), the lighting device (1) may have a different number of PCBs (4), and those PCBs (4) may be connected in parallel or in series. Similarly, the length of each of these PCBs (4) may vary according to the number of PCBs (4) and the length of the base (2).

In the same manner, each of the PCBs (4) may be connected to a variable number of LED light sources (5). In the first embodiment, 16 LED light sources (5) are included and distributed in a single row, however, as stated above, in other embodiments such as, for example, the second preferential embodiment, the LED light sources (5) may be distributed in two or more rows and the number of LEDs (5) connected to each single PCB (4) may vary.

Consequently, given that the maximum length of the base (2) of the luminaire or lighting device (1) is 3 m, in an extreme case and for a minimum spacing between LED light sources (5) of 0.5 cm, the lighting device (1) may contain up to 600 LEDs (5) connected to the PCBs (4) within its interior. Furthermore, as the total quantity of LED light sources (5) of the lighting device (1) is distributed between the PCBs (4) included within the interior of the lighting device (1), and the number of PCBs (4) may vary, each of the PCBs (4) may comprise a greater or lesser number of LED light sources (5).

In this first preferential embodiment of the invention, the four PCBs (4) are connected in parallel and the longitudinal ends of the base (2) include a lateral closure (8) of the lighting device (1). In turn, two PCBs (4) are disposed closest to the two ends of the base (2), and one end of each of the two PCBs (4) is coincident with the corresponding longitudinal end of the base (2), respectively, and comprises a connection cable (11) to the means of supply. Moreover, the lateral closure (8) at both extremities of the base (2) includes a leadout element (not shown in the drawings) of the connection cable (11) through the same. Each lateral closure (8) is sealed with silicone so that the lighting device (1) achieves hermeticity.

Figure 7:
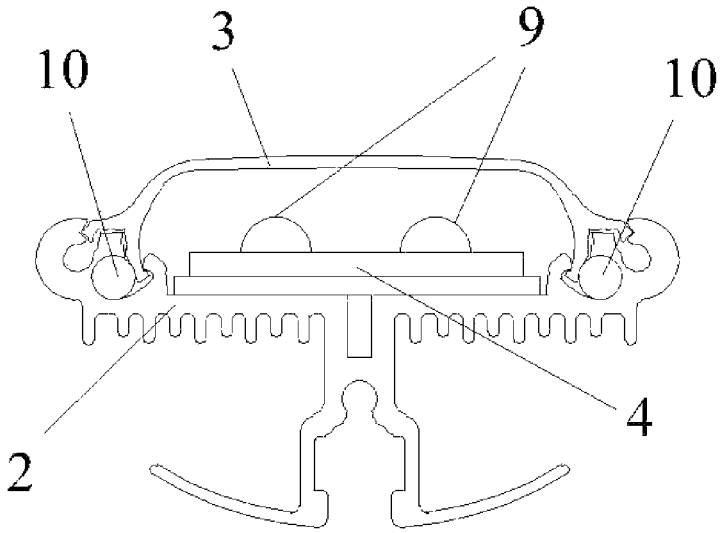
FIG. 7 shows a cross-sectional view of the continuous lighting device of FIG. 6.
Figure 8:
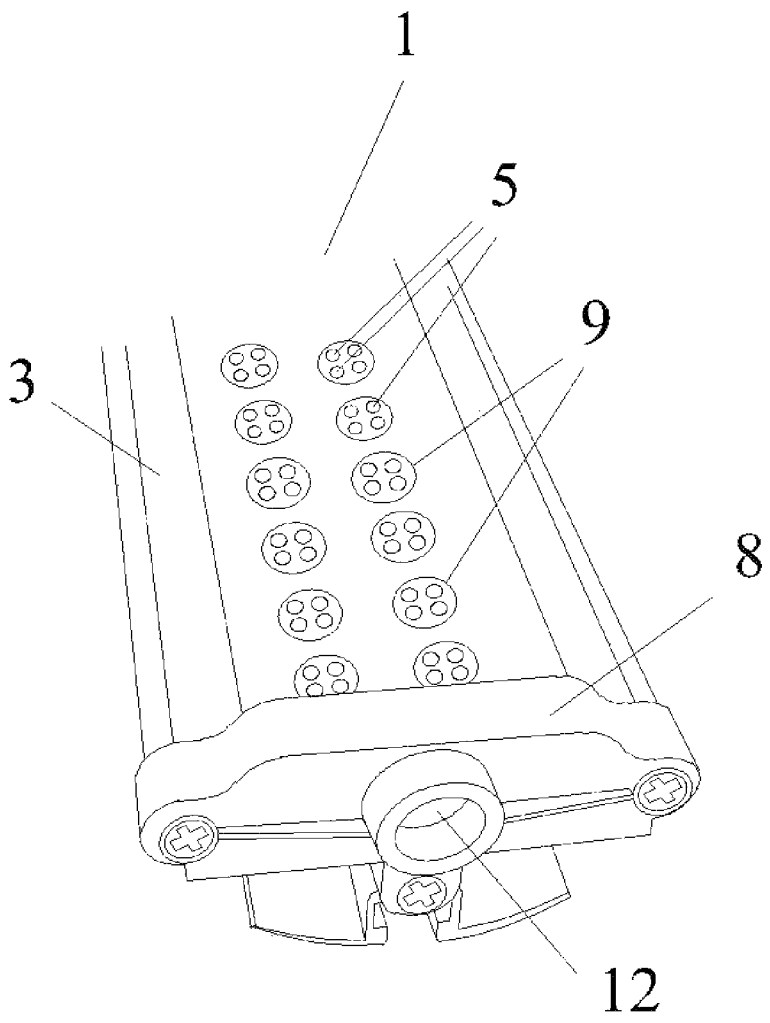
FIG. 8 shows a perspective view of the continuous lighting device of FIG. 6, the lighting device having a lateral closure.

As illustrated in FIGS. 7 and 8, in the second preferential embodiment of the invention each lateral closure (8) includes hermeticity seals (10) of silicone between the lateral closure (8) and the base (2).

Figure 9:
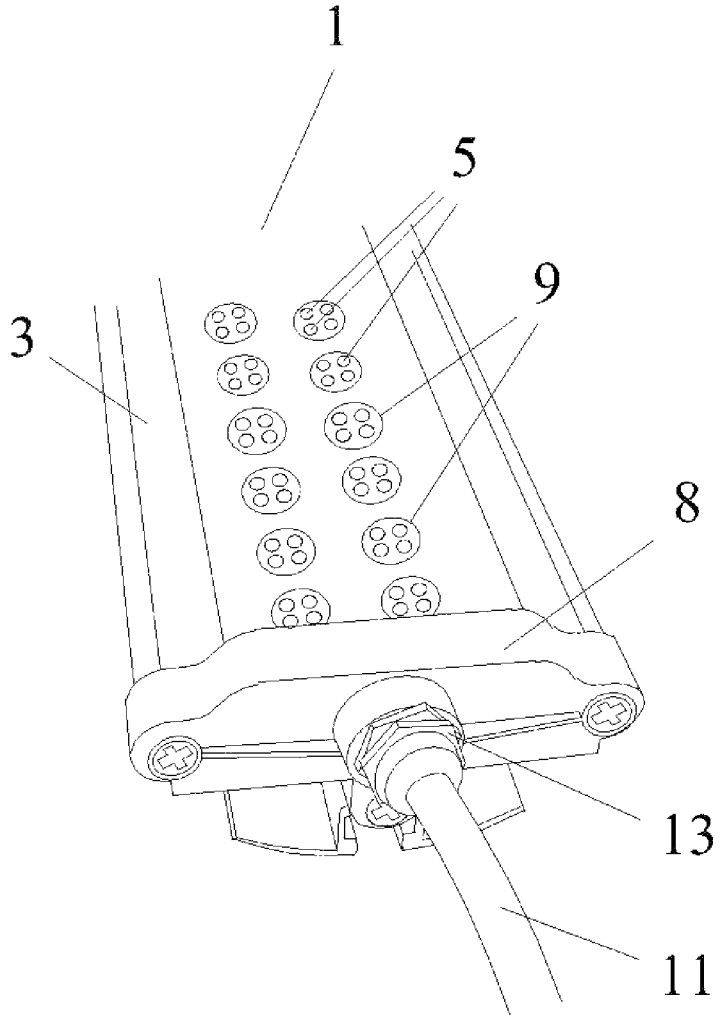
FIG. 9 shows a perspective view of the continuous lighting device of FIG. 8 but also including a connection to the means of supplying current.

In addition, in order to facilitate the passage of the connection cable (11) to the means of supply, each lateral closure (8) includes a leadout orifice (12) and a leadout part (13) in the leadout orifice (12), as may be observed in FIG. 9.

In the first preferential embodiment of the invention, the means of connecting the at least one PCB (4) to the alternating current electrical supply network includes the connection cable (11) as well as means of supplying direct current to the same and means of regulating the current and/or the voltage of the direct current supplied to the LED light sources (5), which may, for example, comprise a driver. In other embodiments, the system may comprise two or more drivers, depending upon the characteristics of said system and of the number of devices of the system.

The second preferential embodiment is an example of a lighting system comprising more than one driver. In addition, in this second preferential embodiment, the LED light sources (5) of a lighting device (1) are connected to at least two drivers disposed in parallel.

In this manner, in this second preferential embodiment, shown in FIG. 6, the LED light sources (5) of the lighting device (1) are arranged into to at least two groups, wherein each of these groups is supplied by a different electrical circuit. As a consequence, this design is particularly useful for being utilized in reinforcement zones of the tunnels, such that part of the LED light sources (5) are supplied by a first electrical circuit configured to provide permanent illumination and another part thereof is supplied by a second electrical circuit configured to provide reinforcement or diurnal illumination. In one example, the luminaire or lighting device (1) has a power of 150 W and is formed by multiple LED light sources (5), such that a part of these LEDs, up to a total of 5 W, are configured to provide the permanent illumination and are supplied by means of an individual driver or one shared with other neighboring lighting devices (1), whilst the remaining LEDs (corresponding to the remaining balance of 145 W) are configured to provide the reinforcement illumination and are also supplied by means of an individual driver or one shared with other neighboring lighting devices (1).

In turn, it is not necessary to have to install some lighting devices (1) for providing the permanent illumination and others for providing the reinforcement lighting, thereby enabling the achievement of lighting system that offers a continuous linear design having the same lighting devices (1), and those lighting devices (1) are effective for both daytime and nighttime illumination in those zones wherein reinforcement lighting is required.

In the first preferential embodiment of the invention, the LED light sources (5) provide a nominal power value equal to between 0 and 100 W and preferably between 0 and 50 W. Furthermore this nominal power is particularly preferably equal to a value between 0 and 5 W. Even more preferably, this nominal power is equal to a value of 0.5 W. However, the power of a LED is not a fixed value but is of a very wide variable range depending on the current supplied at a given instant. For this reason, the present invention does not include operating at maximum power but at a nominal power much below the foregoing.

In addition, the aforementioned driver is utilized for the objective of increasing both the working life and the efficacy of said LED light sources (5). Thus, the power provided by the driver must be at least that nominally required by the LEDs. In this case, the power provided by the driver is equal to 270 W for an assembly of 25 lighting devices (1) each of 2 m in length. An input voltage of between 90 and 295 V AC, an output current of 8 A, and an output voltage of between 40 V DC and 54 V DC are utilized. However, these values are variable, depending on the characteristics of both the driver, the number of lighting devices (1) to be supplied, and the number and power of the LED light sources (5) connected to the same. It will be appreciated that, the power of the driver is not a fixed value but presents a very wide variable range, this power depending on the supply current at every instant of time.

In the first preferential embodiment of the invention, each driver and the associated 25 luminaires or lighting devices (1) constitute a 50 m linear lighting system having 1600 LEDs (5) through each circulates a current of 60 mA. This current is also variable as a function of the driver and the LED light sources (5) to be utilized.

However, in other embodiments, e.g., depending upon the length of the tunnel, the driver may supply a different number of luminaires or lighting devices (1). The number of lighting devices supplied from a single driver may, for example, vary between 1 and 100 units.

When, for example, the driver supplies current to 24 lighting devices (1), corresponding to a tunnel length of 48 m, the current in each LED (5) would be 62.5 mA, resulting in 4.16% more lighting in those 48 m than in the 50 m initially considered. Meanwhile, if the driver supplies current to 26 lighting devices (1), corresponding to a tunnel length of 52 m, the current in each LED (5) would be 57.69 mA, thereby achieving 3.85% less lighting in the stretch of tunnel of 52 m than in that of 50 m.

Moreover, and returning to the first preferred embodiment, which envisions a tunnel length of 50 m illuminated by means of 25 luminaires or lighting devices (1) supplied by the same driver, each of the lighting devices (1) comprises 64 LEDs (5) and, as a consequence, said driver is supplying a total of 1600 LEDs (5). As a result, the power of each of the LEDs (5) is 0.1688 W, much lower than the nominal power corresponding to said LEDs (5), such that greater efficacy will be achieved.

Furthermore, in this first preferred embodiment, the efficacy of each luminaire or lighting device (1) is 129.94 lm/W, arising from the ratio between the light flux emitted by said lighting device (1) (1403 lm) and the power of the same (10.8 W). In other embodiments, this lighting efficacy may vary. The efficacy may vary depending upon the light flux of the lighting device (1) and upon the power of the LED light sources (5) and, consequently, upon the lighting device (1) itself, but generally, the value of this luminous efficacy will lie between 50 and 200 lm/W.

Provided below is a table of the values corresponding to the first preferential embodiment of the invention:

| | LED | PCB | Lighting device | Driver |
|---|---|---|---|---|
| No. of LEDs | 1 | 16 | 64 | 1600 |
| No. of PCBs | 0.0625 | 1 | 4 | 100 |
| Length (m) | 0.031 | 0.5 | 2 | 50 |
| Current (mA) | 60 | 60 | 240 | 6000 |
| Voltage (V DC) | 2.81 | 45 | 45 | 45 |
| Power (W) | 0.1688 | 2.7 | 10.8 | 270 |
| Flux (lm) | 21.93 | 350.8 | 1403 | 35 084 |

In addition, the Applicant has studied the working life of the LED light sources (5) having a soldering temperature (Ts) of 54.5° C. and a continuous output current (If) of 120 mA. From that study, it has been found that solely 30% of the initial luminance is lost after 71 000 hours (>8 years).

In the first preferential embodiment of the invention, the supply is equal to 60 mA, with one half of that considered in the test and, furthermore, with lower night-time values. The reduction of the supply to one half (from 120 mA to 60 mA) significantly improves the life and efficiency of these LED light sources (5). For example, this reduction improves the efficiency of these LED light sources (5) by a value in excess of 150 000 hours (>17 years).

It must be emphasized that the LED light sources (5) continue to be lit even though 30% of the initial luminance thereof has been lost. Consequently, in order to reach a point of the loss of 50% of the same one would have to wait almost 30 years in which case failures of any other component may arise beforehand, and aspects such as the reliability of the LED light sources (5) and the processes of manufacture, handling and maintenance start to be of importance.

In addition, the driver or source of supply is habitually the critical element in the working life of a illumination installation having LEDs. Electrolytic capacitors are located within the interior of the driver or source of supply, and the life of these capacitors greatly depends on the temperature. Thus, this first preferred embodiment employs capacitors of 105° C. and 5000 h, thereby producing a life of 200 000 hours when working at 50° C. (temperature within the interior of the driver). Consequently, approximately 20 years of life are obtained in the drivers by virtue of the high reliability of the capacitors.

In some embodiments, and preferably, the LED light sources (5) situated at adjacent extremities of consecutive luminaires or lighting devices (1) are separated by a distance similar to a distance between two LED light sources (5) of the same lighting device (1), such that the angle of emission (AE) of light rays provided by light sources (5) of consecutive luminaires upon the object area in the longitudinal direction of the tunnel is continuous in the same manner as is the case with consecutive LED light sources (5) of the same lighting device (1).

Preferably, the continuous lighting system described herein provides a symmetrical illumination of light, however, in other embodiments, the continuous lighting system may comprise means generating counterbeam lighting from the LED light sources (5) of a luminaire or lighting device (1). The means of generating the counterbeam lighting may, for example, be formed by a plurality of reflectors each associated with one of said lighting sources.

Figure 3:
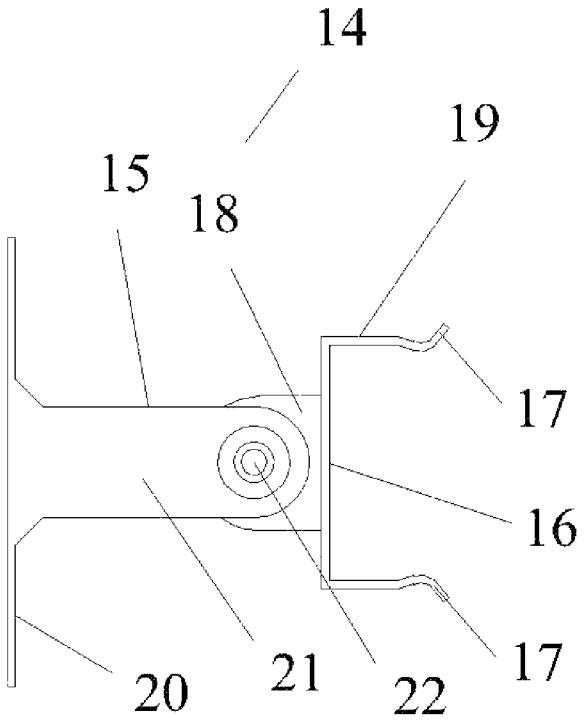
FIG. 3 shows side view of a means of securing a base of the lighting device of FIG. 1 to an interior of a tunnel.
Figure 4:
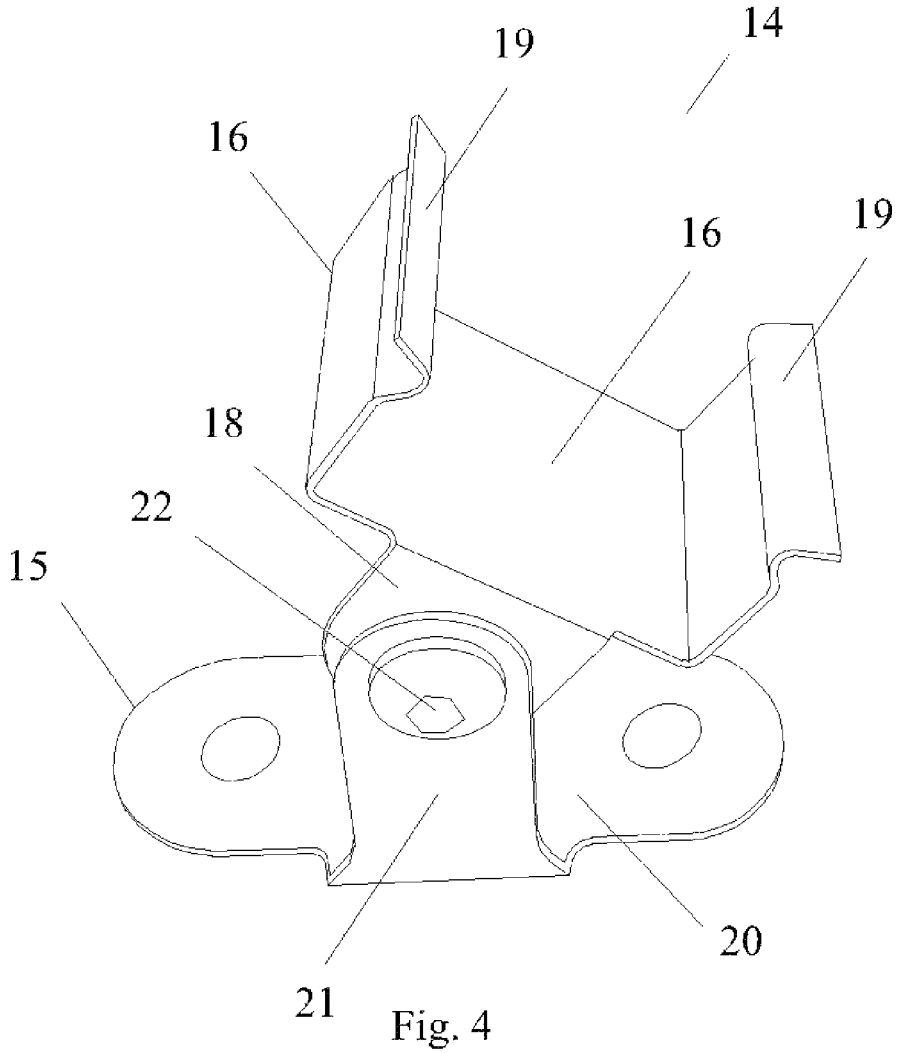
FIG. 4 shows a perspective view of the means of securing the base to the interior of the tunnel shown in FIG. 3, the means having a particular angle of inclination.

Consequently, as shown in FIGS. 3 and 4, the means of securing the longitudinal base (2) of the lighting devices (1) to the interior of the tunnel comprises at least a securing assembly (14). The securing assembly (14) comprises a first part (15) formed by a planar surface (20) suitable for the securing thereof upon the wall or roof of the tunnel through bolted means. The first part (15) also includes parallel flanges (21) that extend perpendicularly from the planar surface (20) and include a through hole that defines a pivoting axis (22).

Furthermore, the securing assembly (14) comprises a second part (19) that includes a planar surface (16) and legs (17) that extend perpendicularly and in a first direction from the planar surface (16). The legs (17) are suitable for the affixation of the base (2). The second part (19) also includes parallel flanges (18) that extend from the planar surface (16) in a second direction opposite the first direction. The parallel flanges (18) include an orifice for securing the pivoting axis (22) of the first part (15), such that the second part (19) is suitable for varying the angle of inclination (AI) with respect to the first part (15).

The angle of inclination (AI) of the light ray in the transverse direction of the tunnel will, as a consequence, be obtained from the combination of the angle of installation of the planar surface (20) upon the wall or roof of the tunnel and the relative angle of rotation between the parts (19) and (15).

The invention claimed is:

1. A lighting device for a road tunnel, the lighting device comprising:

a longitudinal base;

means of securing the base to an interior of the tunnel;

one or more closure elements each having first means of affixation for fixing the closure element to said base, the total length of each the one or more closure elements being substantially equal to a length of the base;

at least one printed circuit board disposed within an interior of the lighting device, the at least one printed circuit board secured to the base;

means of connecting the at least one printed circuit board to an electrical network; and a plurality of LED light sources disposed on said printed circuit board and forming at least one row extending in the longitudinal direction of the printed circuit board, wherein said LED light sources are separated at a distance selected such that the angle of emission of light rays from the plurality of LED light sources provide a substantially uniform illumination output to an object area in a longitudinal direction of the tunnel, wherein the means of securing the base to the interior of the tunnel comprises means of adjusting the base with respect to a transverse direction of the tunnel for adjustment of an angle of inclination of the light rays projected in the transverse direction of the tunnel, wherein the lighting device is configured to form a lighting system including a plurality of lighting devices secured to the interior of the tunnel, such that the lighting devices are arranged in the longitudinal direction of the tunnel and are separated from one another by a distance required to provide a desired illumination output, and wherein a distance between the end LED light sources in adjacent lighting devices is about the same as a distance between two adjacent LED light sources in the same lighting device.

2. The lighting device as claimed in claim 1, wherein each of the one or more closure elements includes an optical lens disposed over the plurality of LED light sources.

3. The lighting device as claimed in claim 1, further comprising a lateral closure disposed at each end of the lighting device, each lateral closure comprising a leadout cable connected to the at least one printed circuit board.

4. The lighting device as claimed in claim 1, wherein the at least one printed circuit board comprises at least two printed circuit boards connected in parallel.

5. The lighting device as claimed in claim 1, wherein the base is formed by a longitudinal extrusion of aluminum.

6. The lighting device as claimed in claim 1, wherein the first means of affixation comprises a plurality of lateral clips configured to engage a plurality of grooves formed in the base.

7. The lighting device as claimed in claim 1, further comprising at least one optical lens disposed within an interior of the base and over at least one LED light source, the at least one optical lens having second means of affixation for fixing the optical lens to the base.

8. The lighting device as claimed in claim 7, further comprising at least two optical lenses, at least one of the optical lenses from another of the lenses.

9. The lighting device as claimed in claim 1, further comprising means of generating counterbeam lighting from one or several of the LED light sources.

10. The lighting device as claimed in claim 9, wherein the means of generating counterbeam lighting comprises a plurality of reflectors, each reflector associated with the one or several of the LED light sources.

11. The lighting device as claimed in claim 1, wherein the means of securing the longitudinal base to the interior of the tunnel comprises a securing assembly, the securing assembly comprising:

a first part formed by a first planar surface adapted to be bolted to a surface of the tunnel, and a plurality of parallel flanges extending from the first planar surface and including a through hole defining a pivoting axis, and a second part including a second planar surface, a plurality of legs extending from the second planar surface in a first direction and suitable for being fixed to the base, and a plurality of parallel flanges extending from the second planar surface in a second direction opposite the first direction, each of the flanges including an orifice configured to be aligned with the pivoting axis of the first part, wherein the first and second parts are configured to be secured to one another such that an angle between the first and second portions is adjustable.

12. The lighting device as claimed in claim 11, wherein, when the lighting device is fixed to the surface of the tunnel by the securing assembly, the angle of inclination of the light rays projected in the transverse direction of the tunnel is adjustable by rotating the second part relative to the first part.

13. The lighting device as claimed in claim 1, wherein the means of connecting the at least one printed circuit board to the electrical network includes means of supplying direct current to the printed circuit board.

14. The lighting device as claimed in claim 13, wherein the means of supplying direct current comprises at least one LED light source driver.

15. The lighting device as claimed in claim 14, wherein the LED light sources are connected to at least two LED light source drivers disposed in parallel.

16. The lighting device as claimed in claim 15, wherein the LED light sources are arranged in at least two groups, wherein each of these groups is supplied by a different electrical circuit.

* * * * *